US006645060B2

(12) United States Patent
Luedeke

(10) Patent No.: US 6,645,060 B2
(45) Date of Patent: Nov. 11, 2003

(54) EXPANDABLE WHEEL FOR SUPPORTING AN ENDLESS ABRASIVE BELT

(75) Inventor: Arthur P. Luedeke, Marine on St. Croix, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/745,040

(22) Filed: Dec. 20, 2000

(65) Prior Publication Data

US 2002/0127961 A1 Sep. 12, 2002

(51) Int. Cl.[7] ..... B24D 9/02
(52) U.S. Cl. ..... 451/504; 451/464; 451/507
(58) Field of Search ..... 451/504, 463, 451/464, 489, 486, 505, 506, 507, 470

(56) References Cited

U.S. PATENT DOCUMENTS

| | | | | |
|---|---|---|---|---|
| 528,534 A | | 11/1894 | Evarts | |
| 967,592 A | | 8/1910 | Wattles | |
| 1,070,284 A | | 8/1913 | Olmsted et al. | |
| 1,110,804 A | * | 9/1914 | Little | 451/504 |
| 1,126,195 A | * | 1/1915 | Granz | 474/52 |
| 1,885,452 A | | 11/1932 | Kuhne | |
| 1,886,733 A | | 11/1932 | Ponselle | |
| 2,046,122 A | | 6/1936 | Hunt | |
| 2,239,140 A | | 4/1941 | Barton et al. | |
| 2,387,298 A | | 10/1945 | Rochwald | |
| 2,628,706 A | * | 2/1953 | Guba | 198/834 |
| 2,745,223 A | | 5/1956 | Toulmin, Jr. | |
| 3,337,998 A | | 8/1967 | Greenfogel | |
| 3,649,036 A | | 3/1972 | Harz | |
| 3,735,535 A | | 5/1973 | Waller | |
| 3,828,489 A | | 8/1974 | Culley, Jr. | |
| 3,869,832 A | | 3/1975 | Atwater | |
| 4,546,576 A | | 10/1985 | Dreiling | |
| 4,555,199 A | | 11/1985 | Maier et al. | |
| 4,823,516 A | | 4/1989 | Matson | |
| 5,007,208 A | | 4/1991 | Garfield | |
| 5,117,592 A | | 6/1992 | Preston | |
| 5,185,970 A | * | 2/1993 | Fiocchi | 51/372 |
| 5,253,816 A | * | 10/1993 | Kastingschafer et al. | 241/227 |
| 5,339,570 A | | 8/1994 | Amundson et al. | |
| 5,509,752 A | | 4/1996 | Kocisek | |
| 5,567,197 A | | 10/1996 | Evensen | |

FOREIGN PATENT DOCUMENTS

| | | |
|---|---|---|
| DE | 1118048 | 11/1961 |
| GB | 2 224 813 | 5/1990 |

OTHER PUBLICATIONS

DC2–86 Dynacushion® "Pneumatic Wheel Adapts to Contour of Work Surface", Dynabrade, Inc., 1986.
"Surface Conditioning Tools and Accessories," Sioux Tools, Inc.
Catalog No. PS–6, "Pneumatic Drum Sanders," Ekstrom, Carlson & Co.
Price/Parts List, Nu–Matic Grinders, Inc., Nov. 1994.
Design News–OEM entitled "This Bicycle Drive is Infinitely Variable,"May 7, 1973.

* cited by examiner

*Primary Examiner*—George Nguyen
*Assistant Examiner*—Dung Van Nguyen
(74) *Attorney, Agent, or Firm*—Melissa E. Buss

(57) ABSTRACT

An expandable wheel for supporting an endless abrasive belt. The present invention relates more particularly to an expandable wheel for supporting an endless abrasive belt, which includes an hub having an axis and a plurality of wheel segments engaged with the hub, where the hub and the plurality of wheel segments are adapted to rotate about the axis, and where the plurality of wheel segments are movable between a first radial position and a second radial position.

39 Claims, 5 Drawing Sheets

EXPANDABLE WHEEL FOR SUPPORTING AN ENDLESS ABRASIVE BELT

TECHNICAL FIELD

The present invention generally relates to an expandable wheel for supporting an endless abrasive belt. The present invention relates more particularly to an expandable wheel for supporting an endless abrasive belt, which includes a hub having an axis and a plurality of wheel segments engaged with the hub, where the hub and the plurality of wheel segments are adapted to rotate about the axis, and where the plurality of wheel segments are movable between a first radial position and a second radial position.

BACKGROUND OF THE INVENTION

Various types of wheels are known for supporting endless abrasive belts. As these wheels are rotated, a work piece may be pushed against the exposed face of the abrasive belt in the area where the belt is supported by the wheel to abrade material from the surface of the work piece. For example, U.S. Pat. No. 528,534, "Expanding Cylinder for Polishing Machines," (Evarts), describes an expandable cylinder, where the surface of the cylinder includes four staves, where two of the staves are immovably supported and the other two staves are movably supported. The movable staves move in an inward direction and through this movement, obtain the contraction desirable for putting the sandpaper on the cylinder. The movable staves are also adapted to be expanded to tighten the sandpaper around the cylinder.

U.S. Pat. No. 1,885,452, "Abrading, Buffing, or Polishing Drum," (Kuhne), describes an expandable drum adapted to receive an endless cylinder of abrasive material. The drum comprises a plurality of sections mounted on a central hub, which may be secured upon a drive shaft. The hub is provided with outwardly projecting apertured lugs or eyes upon which the sections are pivoted by means of shafts extending through the lugs and through inwardly extended apertured lugs or eyes on drum sections. The free ends of each drum section are provided with inwardly projecting hooks arranged to engage with corresponding outwardly extending hooks on the hub. The hooks are undercut so that the centrifugal force developed by rotation of the drums tends to hold the hooks in engagement. The drum expanding devices comprise eccentrics on shafts cooperating with the ends of outwardly projecting lugs on the hub and with the rear faces of the hooks to expand the drum. The eccentrics are self-locking between the faces to hold the drum expanded. The drum sections are of such length that sufficient spaces may be provided to permit the required contraction of the drum and the plates are secured to each section so as to overlie the spaces and complete the periphery of the drum.

U.S. Pat. No. 3,337,998, "Rotary Sharpeners," (Greenfogel), describes a sharpener for a knife blade edge. The sharpener includes an arbor adapted to be mounted on its rotary support and a pair of complementary members connected to the arbor. One of the members is fixed to the arbor and the other member is connected to the arbor in a floating relationship relative to the fixed member. The sharpener also includes a means, such as a spring, for resiliently biasing the members for movement away from one another. An endless abrasive band is placed around the complementary members to define a circular abrading surface for engaging a cutting edge during the sharpening operation. The resilient means maintains the members biased against the inner circumference of the endless band to detachably secure it to the members by friction.

U.S. Pat. No. 5,117,592, "Apparatus and Method for Abrasive Strip Mounting," (Preston), describes a rotatable wheel for removing material from a work-piece. The circumferential surface of the wheel has a transverse slot extending into a cavity within the wheel, which is generally covered by a coverplate secured over the cavity. Within the cavity is a first device for engaging the leading end of the strip and a second device for engaging the trailing end of the abrasive strip. The first device includes a positioner that is operable to align the first device under an opening in the coverplate to permit insertion or removal of the leading end of the strip. Similarly, the second device includes a locator arm that is operable to align the second device under an opening in the coverplate to permit insertion or removal of the trailing end of the abrasive strip. The first device places static tension on the strip, while the second device places dynamic tension on the strip as the wheel is rotated.

U.S. Pat. No. 5,339,570, "Contact Wheel," (Amundson et al.), describes a contact wheel, which comprises an annular support portion having external surfaces and a generally cylindrical peripheral surface. The peripheral surface has spaced edges each adjoining an adjacent external surface and circumferentially spaced elongate grooves formed therein with land portions disposed between the grooves. The grooves are spaced from the respective adjacent edges of the peripheral surface to provide annular land surfaces at each of the peripheral surface. The contact wheel further includes one or more passageways formed therein, which communicate with a groove at a first end of the passageway, and with either an external surface of the annular support portion, or an adjacent groove at a second end of the passageway. The passageways aid in reducing the amount of noise generated by the contact wheel when it is rotated with the abrasive belt entrained thereover.

SUMMARY OF THE INVENTION

One aspect of the present invention provides an expandable wheel for supporting an endless abrasive belt. The expandable wheel comprises: a) a hub, including an axis; and b) a wheel segment engaged with the hub, where the hub and the wheel segment are adapted to rotate about the axis, where the plurality of wheel segment is moveable between a first radial position and a second radial position, where the first radial position is located at a first radius from the axis, where the second radial position is located at a second radius from the axis, where the first radius is less than the second radius, where the wheel segment includes a peripheral surface for supporting an endless abrasive belt, and where the peripheral surface includes a first oblique edge and a second oblique edge opposite the first oblique edge, and where the first oblique edge and the second oblique edge are oblique to the direction of wheel rotation. In another aspect of this embodiment, the expandable wheel further comprises a plurality of wheel segments engaged with the hub, where the hub and the plurality of wheel segments are adapted to rotate about the axis, where the plurality of wheel segments are moveable between the first radial position and the second radial position, and where each of the plurality of wheel segments includes the peripheral surface for supporting an endless abrasive belt. In another aspect of this embodiment, when the wheel segments are in the second radial position, the first oblique edge of a first wheel segment of the plurality of wheel segments is spaced apart from the second oblique edge of a second wheel segment of the plurality of wheel segments.

In another preferred embodiment of the above expandable wheel, each of the plurality of wheel segments include a first oblique side surface extending from the first oblique edge, a second oblique side surface extending from the second oblique edge opposite the first oblique side surface, and the peripheral surface extending between the first oblique side surface and the second oblique side surface. In another aspect of this embodiment, the first oblique side surface of a first wheel segment of the plurality of wheel segments is parallel with the second oblique side surface of a second wheel segment of the plurality of wheel segments. In yet another aspect of this embodiment, the first oblique side surface of a first wheel segment of the plurality of wheel segments is parallel with the second oblique side surface of the first wheel segment.

In another preferred embodiment of the above expandable wheel, the hub includes a mechanical stop, where the mechanical stop prevents the wheel segment from radially expanding beyond the second radial position.

In yet another preferred embodiment of the above expandable wheel, the expandable wheel further comprises a means for moving the plurality of wheel segments between the first radial position and the second radial position. In another aspect of this embodiment, the means for moving the plurality of segments is rotatable between a first circumferential position and a second circumferential position, where when the means is in the first circumferential position, the plurality of wheel segments are in the first radial position, and where when the means is in the second circumferential position, the plurality of wheel segments are in the second radial position. In another aspect of this embodiment, the means for moving the plurality of wheel segments comprises a cam engaged with the hub, where the cam includes slots, where each of slots include a first radial end and a second radial end opposite the first radial end, where the first radial end is located at a first radius from the axis, where the second radial end is located at a second radius from the axis, where the first radius is less than the second radius, and cam followers attached to the wheel segments, where the cam followers are slideably engaged with the cam slots. In yet another aspect of this embodiment, the means for moving the plurality of wheel segments moves all of the plurality of wheel segments simultaneously between the first radial position and the second radial position.

Another aspect of the present invention provides an alternative expandable wheel for supporting an endless abrasive belt. The expandable wheel comprises: a) a hub, including an axis; b) a wheel segment engaged with the hub, where the hub and the wheel segment is adapted to rotate about the axis, where the wheel segment is moveable from a first radial position to a second radial position, where the first position is at located at a first radius from the axis, where the second position is located at a second radius from the axis, where the first radius is less than the second radius, where the wheel segment includes a peripheral surface for supporting an endless abrasive belt; c) a mechanical stop engaged with the hub, where the mechanical stop prevents the plurality of wheel segments from expanding beyond the second radial position; and d) means for simultaneously moving the plurality of wheel segments between the first radial position and the second radial position. In another aspect of this embodiment, the expandable wheel further comprises a plurality of wheel segments engaged with the hub, where the hub and the plurality of wheel segments are adapted to rotate about the axis, where the plurality of wheel segments are moveable between the first radial position and the second radial position, and where each of the plurality of wheel segments includes the peripheral surface for supporting an endless abrasive belt.

In another preferred embodiment of the above expandable wheel, each of the peripheral surfaces includes a first oblique edge and a second oblique edge opposite the first oblique edge, and where the first oblique edge and the second oblique edge are oblique to the direction of wheel rotation.

In yet another preferred embodiment of the above expandable wheel, each of the plurality of wheel segments include a first oblique side surface extending from the first oblique edge, a second oblique side surface extending from the second oblique edge opposite the first oblique side surface, and the peripheral surface extending between the first oblique side surface and the second oblique side surface. In another aspect of this embodiment, the first oblique side surface of a first wheel segment of the plurality of wheel segments is parallel with the second oblique side surface of a second wheel segment of the plurality of wheel segments. In yet another aspect of this embodiment, the first oblique side surface of a first wheel segment of the plurality of wheel segments is parallel with the second oblique side surface of the first wheel segment.

In another preferred embodiment of the above expandable wheel, when the wheel segments are in the second radial position, the first oblique edge of a first wheel segment of the plurality of wheel segments is spaced apart from the second oblique edge of a second wheel segment of the plurality of wheel segments.

In yet another preferred embodiment of the above expandable wheel, the means for simultaneously moving the plurality of wheel segments is rotatable between a first circumferential position and a second circumferential position, where when the means is in the first circumferential position, the plurality of segments are in the first radial position, and where when the means is in the second circumferential position, the plurality of segments are in the second radial position. In another aspect of this embodiment, the means for simultaneously moving the plurality of wheel comprises: i) a cam engaged with the hub, where the cam includes slots, where each of slots include a first radial end and a second radial end opposite the first radial end, where the first radial end is located at a first radius from the axis, where the second radial end is located at a second radius from the axis, where the first radius is less than the second radius; and ii) cam followers attached to the wheel segments, where the cam followers are slideably engaged with the cam slots.

Another aspect of the present invention provides yet another alternative expandable wheel for supporting an endless abrasive belt. The expandable wheel comprises: a) a hub, including an axis; b) a plurality of wheel segments engaged with the hub, where the hub and the plurality of wheel segments are adapted to rotate about the axis, where the plurality of wheel segments are moveable between a first radial position and a second radial position, where the first position is at located at a first radius from the axis, where the second position is located at a second radius from the axis, where the first radius is less than the second radius, and where each of the plurality of wheel segments includes a peripheral surface for supporting an endless abrasive belt; and c) means for simultaneously moving the plurality of wheel segments between the first radial position and the second radial position, where the means for moving the plurality of wheel segments is rotatable from a first circumferential position to a second circumferential position without significant axial travel, and where when the means for simultaneously moving the plurality of wheel segments is in the first circumferential position, the plurality of wheel segments are in the first radial position, and where when the means for simultaneously moving the plurality of wheel segments is in the second circumferential position, the plurality of wheel segments are in the second radial position.

In one preferred embodiment of the above expandable wheel, each of the peripheral surfaces include a first oblique edge and a second oblique edge opposite the first oblique edge, and where the first oblique edge and the second oblique edge are oblique to the direction of wheel rotation. In another aspect of this embodiment, each of the plurality of wheel segments include a first oblique side surface extending from the first oblique edge, a second oblique side surface extending from the second oblique edge opposite the first oblique side surface, and the peripheral surface extending between the first oblique side surface and the second oblique side surface. In another aspect of this embodiment, the first oblique side surface of a first wheel segment of the plurality of wheel segments is parallel with the second oblique side surface of a second wheel segment of the plurality of wheel segments. In yet another aspect of this embodiment, the first oblique side surface of a first wheel segment of the plurality of wheel segments is parallel with the second oblique side surface of the first wheel segment.

In another preferred embodiment of the above expandable wheel, when the plurality wheel segments are in the second radial position, the first oblique edge of a first wheel segment of the plurality of wheel segments is spaced apart from the second oblique edge of a second wheel segment of the plurality of wheel segments.

In another preferred embodiment of the above expandable wheel, the hub includes a mechanical stop, where the mechanical stop prevents the plurality of wheel segments from radially expanding beyond the second radial position.

In yet another preferred embodiment of the above expandable wheel, the means for simultaneously moving the plurality of wheel segments comprises: i) a cam engaged with the hub, where the cam includes slots, where the each of slots include a first radial end and a second radial end opposite the first radial end, where the first radial end is located at a first radius from the axis, where the second radial end is located at a second radius from the axis, where the first radius is less than the second radius; and ii) cam followers attached to the wheel segments, where the cam followers are slideably engaged with the cam slots.

Another aspect of the present invention provides yet another alternative expandable wheel for supporting an endless abrasive belt, comprising: a) a hub, including an axis; b) a plurality of wheel segments engaged with the hub, where the hub and the plurality of wheel segments are adapted to rotate about the axis, where the plurality of wheel segments are moveable between a first radial position and a second radial position, where the first position is at located at a first radius from the axis, where the second position is located at a second radius from the axis, where the first radius is less than the second radius, and where each of the plurality of segments includes a peripheral surface for supporting an endless abrasive belt; and c) means for simultaneously moving the wheel segments between the first radial position and the second radial position.

In one preferred embodiment of the above expandable wheel, each of the peripheral surfaces includes a first oblique edge and a second oblique edge opposite the first oblique edge, and where the first oblique edge and the second oblique edge are oblique to the direction of wheel rotation.

In another preferred embodiment of the above expandable wheel, the plurality of wheel segments include a first oblique side surface extending from the first oblique edge, a second oblique side surface extending from the second oblique edge opposite the first oblique side surface, and the peripheral surface extending between the first oblique side surface and the second oblique side surface. In another aspect of this embodiment, the first oblique side surface of a first wheel segment of the plurality of wheel segments is parallel with the second oblique side surface of a second wheel segment of the plurality of wheel segments. In yet another aspect of this embodiment, the first oblique side surface of a first wheel segment of the plurality of wheel segments is parallel with the second oblique side surface of the first wheel segment.

In another preferred embodiment of the above expandable wheel, when the plurality of wheel segments are in the second radial position, the first oblique edge of a first wheel segment of the plurality of wheel segments is spaced apart from the second oblique edge of a second wheel segment of the plurality of wheel segments.

In another preferred embodiment of the above expandable wheel, the hub includes a mechanical stop, where the mechanical stop prevents the plurality of wheel segments from radially expanding beyond the second radial position.

In yet another preferred embodiment of the above expandable wheel, the means for simultaneously moving the plurality of segments is rotatable between a first circumferential position and a second circumferential position, and where when the means is in the first circumferential position, the plurality of segments are in the first radial position, where when the means is in the second circumferential position, the plurality wheel of segments are in the second radial position. In another aspect of this embodiment, the means for simultaneously moving the plurality of wheel comprises: i) a cam engaged with the hub, where the cam includes slots, where the each of slots include a first radial end and a second radial end opposite the first radial end, where the first radial end is located at a first radius from the axis, where the second radial end is located at a second radius from the axis, where the first radius is less than the second radius; and ii) cam followers attached to the wheel segments, where the cam followers are slideably engaged with the cam slots.

Another aspect of the present invention provides another alternative expandable wheel for supporting an endless abrasive belt. The expandable wheel comprises: a) a hub, including an axis; b) a plurality of wheel segments engaged with the hub, where the hub and the plurality of wheel segments are adapted to rotate about the axis, where the plurality of wheel segments are moveable from a first radial position to a second radial position, where the first position is at located at a first radius from the axis, where the second position is located at a second radius from the axis, where the first radius is less than the second radius, where each of the plurality of wheel segments includes a peripheral surface for supporting an endless abrasive belt; c) a mechanical stop engaged with the hub, where the mechanical stop prevents the plurality of wheel segments from expanding beyond the second radial position; d) a cam engaged with the hub, where the cam includes slots, where the each of slots include a first radial end and a second radial end opposite the first radial end, where the first radial end is located at a first radius from the axis, where the second radial end is located at a second radius from the axis, where the first radius is less than the second radius; and e) cam followers attached to the wheel segments, where the cam followers are slideably engaged with the cam slots.

Another aspect of the present invention provides an alternative expandable wheel for supporting an endless abrasive belt. The expandable wheel comprises: a) a hub, including an axis; b) a plurality of wheel segments engaged with the hub, where the hub and the plurality of wheel segments are adapted to rotate about the axis, where the plurality of wheel segments are moveable between a first radial position and a second radial position, where the first position is at located at a first radius from the axis, where the second position is located at a second radius from the axis, where the first radius is less than the second radius, and where each of the plurality of segments includes a peripheral surface for supporting an endless abrasive belt; c) a cam engaged with the hub, where the cam includes slots, where the each of slots include a first radial end and a second radial end opposite the first radial end, where the first radial end is located at a first radius from the axis, where the second radial end is located at a second radius from the axis, where the first radius is less than the second radius; and d) cam followers attached to the wheel segments, where the cam followers are slideably engaged with the cam slots.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

The present invention provides an expandable wheel for supporting an endless abrasive belt. In one preferred embodiment, the expandable wheel includes a plurality of wheel segments that are movable between a first radial position and a second radial position, which is convenient for initially putting on an abrasive belt, supporting an abrasive belt while the wheel is in use, and for taking the abrasive belt off the wheel. While the wheel segments are in the first radial position, a user may slip an abrasive belt around the wheel. Then, the wheel segments may be moved into the second radial position to provide support to the abrasive belt and allow a user to abrade a work piece. Afterwards, the wheel segments may be moved back into the first radial position, to allow a user to remove the used endless abrasive belt from the wheel and replace it with a new abrasive belt. In another preferred embodiment, the expandable wheel includes a plurality of wheel segments, where at least one of the wheel segments is moveable between a first radial position and a second radial position and where other wheel segments remain stationary. In this embodiment, when the moveable wheel segment is in the first radial position, a user may slip an endless abrasive belt around the wheel. Then, the moveable wheel segment may be moved to the second radial position to provide support for the abrasive belt. Alternatively, the expandable wheel may include any combination of moveable and stationary wheel segments.

Figure 1:
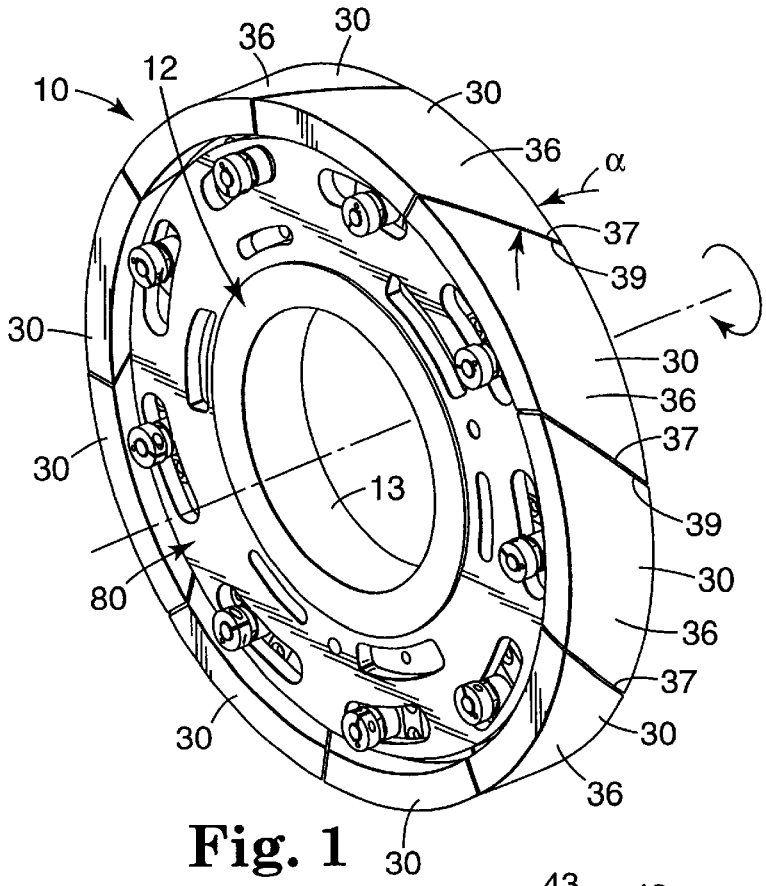
FIG. 1 is an isometric view of a preferred embodiment of an expandable wheel of the present invention.

FIG. 1 illustrates one preferred embodiment of the expandable wheel 10. The expandable wheel 10 includes a hub 12 and a plurality of wheel segments 30 engaged with the hub 12. The hub 12 includes an axis and an inner surface 13. Inner surface 13 of hub 12 is provided to mount the expandable wheel 10 on a shaft (not shown) to allow the expandable wheel to rotate about the axis. The wheel segments 30 are distributed evenly around the hub 12. In the illustrated embodiment, the wheel 10 includes nine wheel segments. However, the expandable wheel 10 may include fewer or more wheel segments 30. The expandable wheel 10 also includes a cam 80 engaged with both the hub and plurality of wheel segments 30. Each of the wheel segments 30 are shaped to generally fit along side adjacent wheel segments 30.

Each of the wheel segments 30 includes a peripheral surface 36. The peripheral surface 36 includes a first edge 37 and a second edge 39 opposite the first edge 37. The first edge 37 of a first wheel segment 30 is configured to generally align with the second edge 38 of an adjacent wheel segment 30. In other words, the edges of the wheel segments 30 are designed to fit closely next to each other. Preferably, edges 37, 39 are oblique to the direction of the wheel rotation. Preferably, the first oblique edge 37 of a first wheel segment 30 is parallel with the second oblique edge 39 of the same wheel segment 30. More preferably, the first oblique edge 37 of a first wheel segment 30 is parallel with a second oblique edge 39 of the adjacent wheel segment 30. Preferably, the oblique edges 37, 39 are at an angle a relative to the direction of rotation of the wheel 10. Preferably, angle $\alpha$ is between 5° and 60°. More preferably, angle a is between 15° and 45°. Most preferably, angle $\alpha$ is between 30° and 45°. Preferably, the angle $\alpha$ is at a steep angle relative to the rotation of the wheel to provide for longer edges 37, 39.

The first edge 37 and second edge 39 of the peripheral surface 36 of the wheel segments 30 are preferably oblique to direction of wheel rotation to help minimize chatter that is created when the wheel 10 and an abrasive belt are in use, abrading a work piece. As the wheel 10 and abrasive belt rotate together about the axis, a work piece is pressed up against the abrasive belt. While pressed against the abrasive belt, the work piece may contact slight depressions or bumps along the surface of the abrasive belt, which correspond to the gaps created between the first edges 37 and second edges 39 of the expanded wheel segments 30. Between the first edges 37 and second edges 39 of the expanded wheel segments 30, there is nothing supporting the backside of the abrasive belt. As the wheel 10 and abrasive belt rotate, the work piece will contact only a portion of the depressions or bumps because the edges 37, 39 are oblique to the direction of the wheel rotation. By gradually contacting only a portion of the depression or bump between the edges 37, 39, the chatter between wheel 10 and work piece is minimized. As the work piece travels over a portion of the depression between the edges 37,39, there is a smooth transition of support for the abrasive belt and work piece between adjacent wheel segments 30. If instead the first edges 37 and second edges 39 of the wheel segments 30 were perpendicular to the direction of wheel rotation, the work piece would contact all of the depressions and bumps at once, creating more chatter between the wheel 10 and work piece. Thus, it is preferred that the first edges 37 and second edges 39 of the wheel segments 30 are oblique to the direction of wheel rotation to help minimize the chatter between the wheel 10, the abrasive belt and work piece while in use.

The illustrated wheel segments 30 include first and second edges 37, 39 at the same angle $\alpha$. This is to allow the wheel segments 30 to fit closely together to help minimize the gap between the first and second edges 37, 39 of adjacent wheel segments.

However, it is not necessary that the first and second edges 37, 39 all be at the same angle $\alpha$. For example, the first and second edges 37, 39 of one wheel segment 30 may include the first edges 37 at a positive angle $\alpha$ and the second edge 39 at a negative angle $\alpha$. The first and second edges 37, 39 may be at any angle so long as the wheel segments 30 fit closely to one another. Preferably, the first and second edges are at an angle to be oblique to the direction of wheel rotation to help minimize the chatter, as discussed above.

Figure 2:
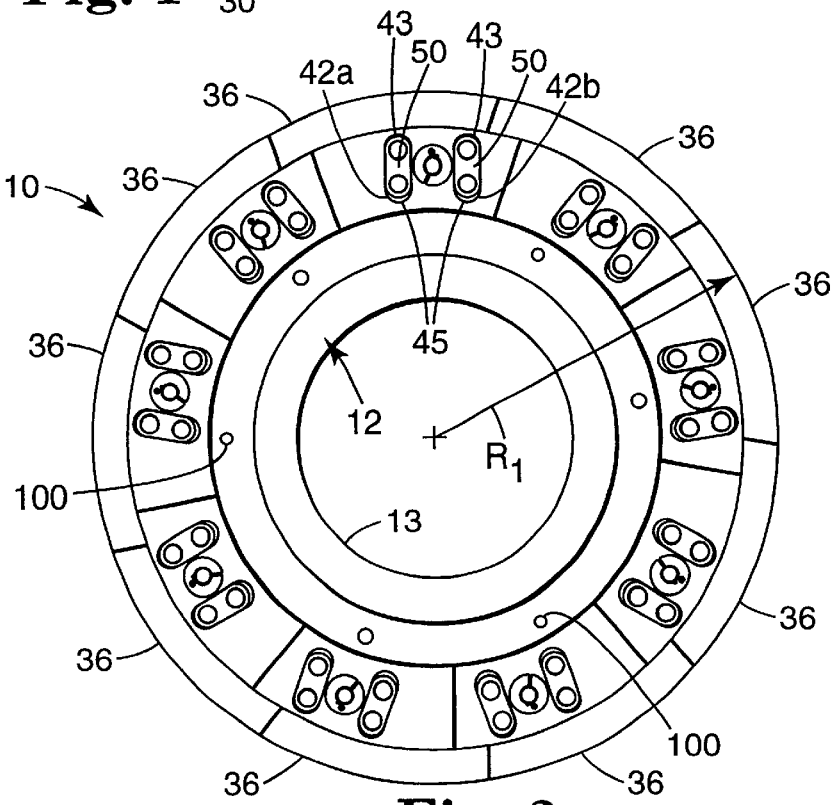
FIG. 2 is a side view of the expandable wheel of FIG. 1 with the cam removed, showing the wheel in its first radial position.

FIG. 2 illustrates a side view of the expandable wheel 10 with the cam 80 removed to illustrate the hub 12 and the plurality of wheel segments 30. In operation, it is not necessary to remove the cam 80. FIG. 2 illustrates the expandable wheel 10 in its first radial position, where the wheel segments 30 are retracted relative to the hub 12. In the first radial position, the expandable wheel has a first radius $R_1$. First radius $R_1$ is measured from the wheel axis to the peripheral surface 36 of the wheel segments 30. When the wheel 10 is in the first radial position, the plurality of wheel segments 30 are located closely adjacent to each other. Preferably, while the wheel 10 is in the first radial position, the wheel segments 30 have no spaces between them. More preferably, while the wheel 10 is in its first radial position, the wheel 10 has a continuous peripheral surface made from all of the individual peripheral surfaces 36 of wheel segments 30.

Each of the wheel segments 30 is engaged with the hub 12, so that the segments 30 may move radially relative to the hub 12. Preferably, each of the wheel segments 30 is attached to the hub 12 by a mechanical stop 50. More preferably, each of the wheel segments 30 is attached to the hub 12 by two mechanical stops 50, as illustrated in FIG. 2. The mechanical stops 50 are attached to both the hub 12 and the wheel segments 30. The mechanical stops 50 are permanently attached to the hub 12 in fixed locations, while the wheel segment 30 radially slide back and forth against the mechanical stops 50. The wheel segments 30 preferably include at least one segment slot 42 for receiving the mechanical stop 50. More preferably, each of the wheel segments 30 includes two segments slots 42*a* and 42*b* for receiving the corresponding mechanical stops 50, as shown in FIG. 2. Each of the segment slots 42*a*, 42*b* includes a first segment end slot 43 and a second segment slot end 45 opposite the first segment slot end 43. The segment slots 42*a*, 42*b* are larger than the mechanical stop 50, to allow the wheel segments 30 to slide back and forth against the mechanical stops 50. The individual wheel segments 30 slide back and forth between a first radial position and a second radial position along segment slots 42. Because the mechanical stops 50 are attached to the hub 12 in a fixed location, the mechanical stops prevent the wheel segment 30 from sliding beyond the first radial position or the second radial position. Preferably, the first radial position and second radial positions of all of the wheel segments 30 are the same or similar relative to the axis of the wheel 10 to provide a constant radius all around the wheel when the wheel segments are in either position.

FIG. 2 illustrates the wheel segments 30 of the expandable wheel 10 in the first radial position. When the wheel segments 30 are moved into the first radial position, the mechanical stop 50 engages with the first segment slot end 43 to prevent the wheel segments 30 from moving any further inward and to hold the wheel segments 30 in position. While the wheel segments are in their first radial position, there is some space between the mechanical stops 50 and the second segment slot end 45. While the wheel segments 30 are in the first radial position, the expandable wheel has a first radius $R_1$, which is measured from the wheel axis to the peripheral surface 36 of the wheel segments 30. While the wheel segments are in the first radial position, a user may slip an endless abrasive belt having a radius greater than $R_1$ around the expandable wheel.

Figure 3:
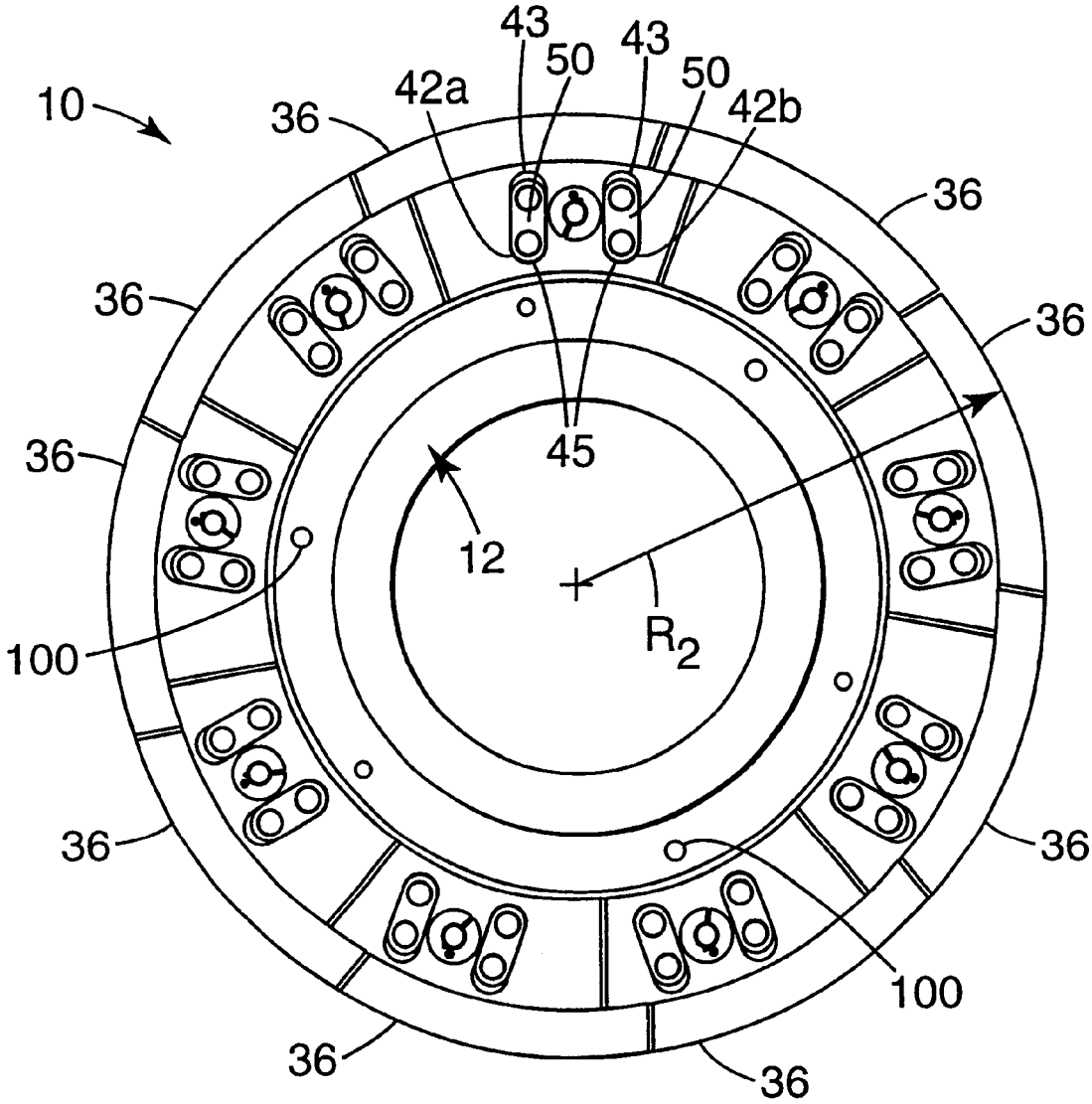
FIG. 3 is the expandable wheel of FIG. 1 with the cam removed, showing the wheel in its second radial position.

FIG. 3 illustrates the wheel segments 30 of the expandable wheel 10 in the second radial position. In the second radial position, the expandable wheel 10 has a second radius $R_2$, which is measured from the hub axis to the peripheral surface 36 of the wheel segment 30. The second wheel radius $R_2$ is larger than the first wheel radius $R_1$. When the wheel segments 30 are in the second radial position, a larger wheel radius supports the endless abrasive belt. In the second radial position, the wheel 10 preferably has a constant radius $R_2$.

As the wheel segments 30 are moved from the first radial position to the second radial position, they slide along the segment slot 42, which is engaged with the mechanical stops 50. The mechanical stops X prevent the wheel segments 30 from sliding radially outward any further than the second radial position. When the wheel segments are moved to the second radial position, the wheel segments slide against the stationary mechanical stops 50. The mechanical stops 50 engage with the second segment slot end 45, preventing the wheel segments 30 from moving any further and hold the wheel segments 30 in the second radial position. While the wheel segments 30 are in their second radial position, there is space between the mechanical stops 50 and the first segment slot ends 43, as illustrated in FIG. 3.

Figure 4:
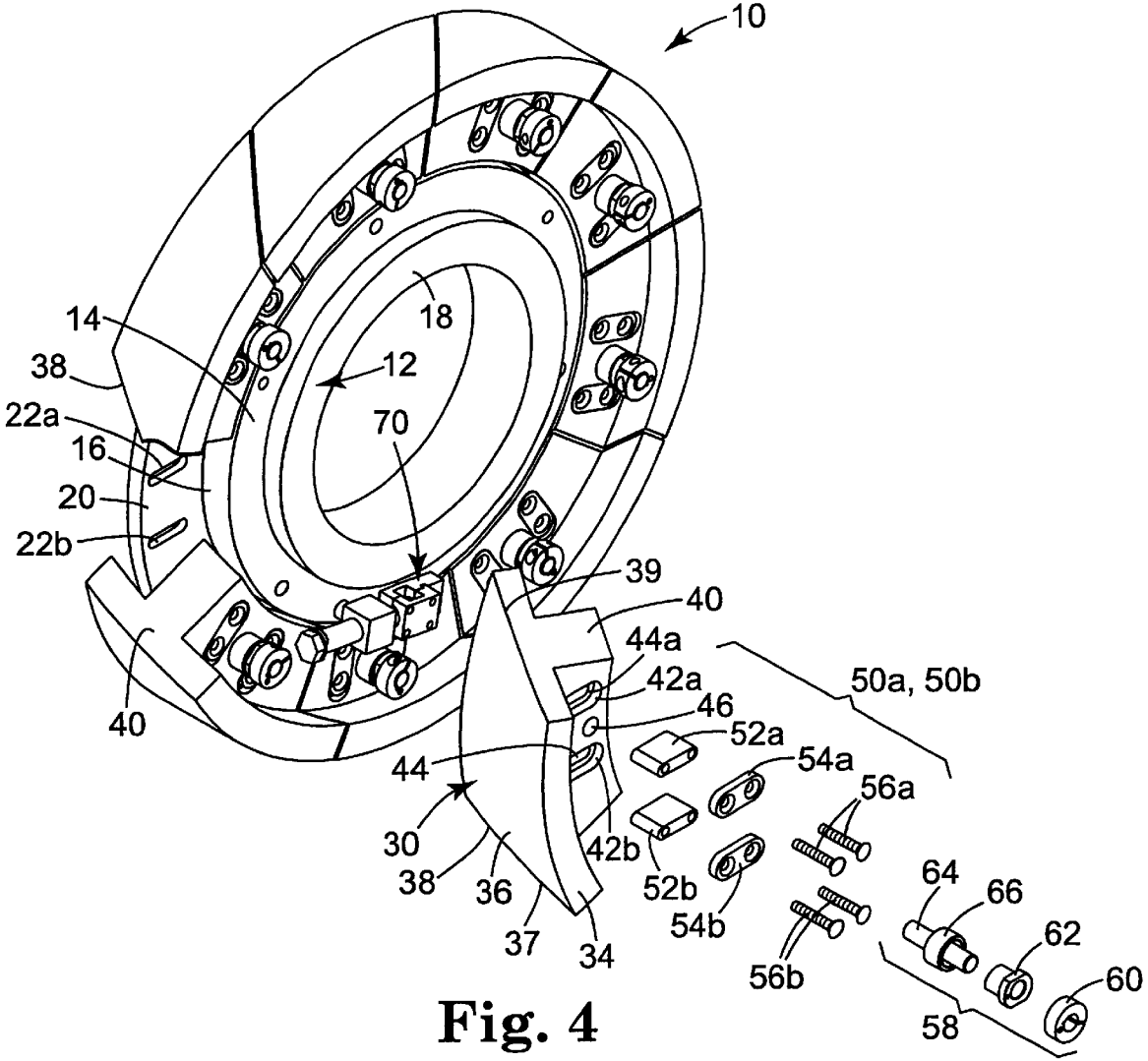
FIG. 4 is the expandable wheel of FIG. 1 with the cam removed, showing one of the wheel segments in an exploded view.

FIG. 4 illustrates the hub 12 and illustrates one of the wheel segments 30, a mechanical stops 50, and a cam follower 58 in an exploded view. The hub 12 includes a rim 20 and an annular portion 14 having an annular surface 16. Preferably, the rim 20 includes recesses 22 for receiving the mechanical stops 50. The mechanical stops 50 are pressed fit into the recesses 22. The recesses 22 also include holes for receiving pins 56, which are not shown. The rim 20 includes a first recess 22*a* and a second recess 22*b* for each wheel segment 30.

The wheel segment 30 includes a first side surface 38 extending from the first oblique edge 37 and a second side surface 40 extending from the second oblique edge 39. Preferably, first side surface 38 and second side surface 40 are oblique to the direction of the wheel rotation. Preferably, the oblique side surface 38 of the wheel segment 30 is parallel to the second oblique side surface 40 of the same wheel segment 30. More preferably, the first oblique side surface 38 of the wheel segment 30 corresponds generally to the second side surface 40 of an adjacent wheel 30. The wheel segment 30 includes a first segment slot 42*a* and a second segment slot 42*b*. Within each segment slot 42*a*, 42*b*, the segment slot includes a segment slot groove 44. A dowel hole 46 is located between the segment slots 42*a*, 42*b*.

The wheel segments 30 move radially between a first radial position and a second radial position to provide a wheel 10 having two different radiuses. When the wheel segments are in the first radial position, the wheel has a first radius, allowing a user to slip an abrasive belt around the wheel 10. The wheel segments 30 may then slide radially to the second radial position to provide a wheel with a second radius, larger than the first radius, to support for the abrasive belt. The wheel segments 30 slide between the first radial position and the second radial position. The stationary mechanical stops 50 prevent the wheel segments from sliding radially beyond either the first radial position or the second radial position. The cam 80 helps move the wheel segments 30 between the first radial position and the second radial position. When the cam 80 is rotated circumferentially in one direction, the wheel segments 30 slide to the first radial position.

When the cam 80 is rotated circumferentially in the opposite direction, the wheel segments 30 slide to the second radial position.

Mechanical stop 50 includes a key 52, a keeper 54, and threaded pins 56. The threaded pins 56 fit through the holes in keeper 54, extend into the holes located in the key 52, and are threaded into the holes located in recesses 22 in plate 20. The mechanical stop 50 fits into the segment slot 42 in the wheel segment 30 and also engages with the recess 22 located on the hub 12. Preferably, each wheel segment includes two mechanical stops 50*a* and 50*b*. Mechanical stop 50*a* includes a key 52*a*, a keeper 54*a*, and two threaded pins 56*a*. Mechanical stop 50*b* includes a key 52*b*, a keeper 54*b* and threaded pins 56*b*. As the wheel segment 30 moves from the first radial position to the second radial position, the mechanical stops 50*a* and 50*b* remain stationary because they are attached the hub rim 20 at recesses 22. As the wheel segment 30 moves from the first radial position to the second radial position, the wheel segment 30 slides along groove 44 along the edge of the keeper 54 of the mechanical stop 50. The mechanical stops 50*a*, 50*b* physically and mechanically prevent the wheel segment 30 from radially sliding beyond the first radial position or the second radial position. The segment slots 42*a*, 42*b* in wheel segments 30 are sized to only allow the segment 30 to slide between the first and second radial position. The mechanical stops 50*a*, 50*b* within the segment slots 42*a*, 42*b* remain stationary and physically prevent the wheel segments 30 from sliding beyond the first or second radial positions.

It is advantageous to a stationary mechanical stops 50*a*, 50*b* because it provides a simple way without moving parts to ensure that each wheel segment 30 will not slide beyond the second radial position. In addition, the mechanical stops ensure that the wheel 10 will have a constant radius all around the wheel, which also helps minimize chatter between the wheel and a work piece while in use. Because the mechanical stops are stationary, the wheel segments 30 do not move radially under grinding pressure.

The cam follower 58 includes the dowel pin 64, an eccentric 62, and a clamp collar 60. The dowel pin 64 includes a shoulder 66 located around it. The dowel pin 64 fits into the dowel hole 46 on the wheel segment 30 by press fitting the dowel pin 64 into the dowel hole 46. The clamp collar 60 fits around the eccentric 62. The clamp collar 60 and eccentric 62 engage with the dowel pin 64, which is then engaged with the wheel segment 30.

Figure 5:
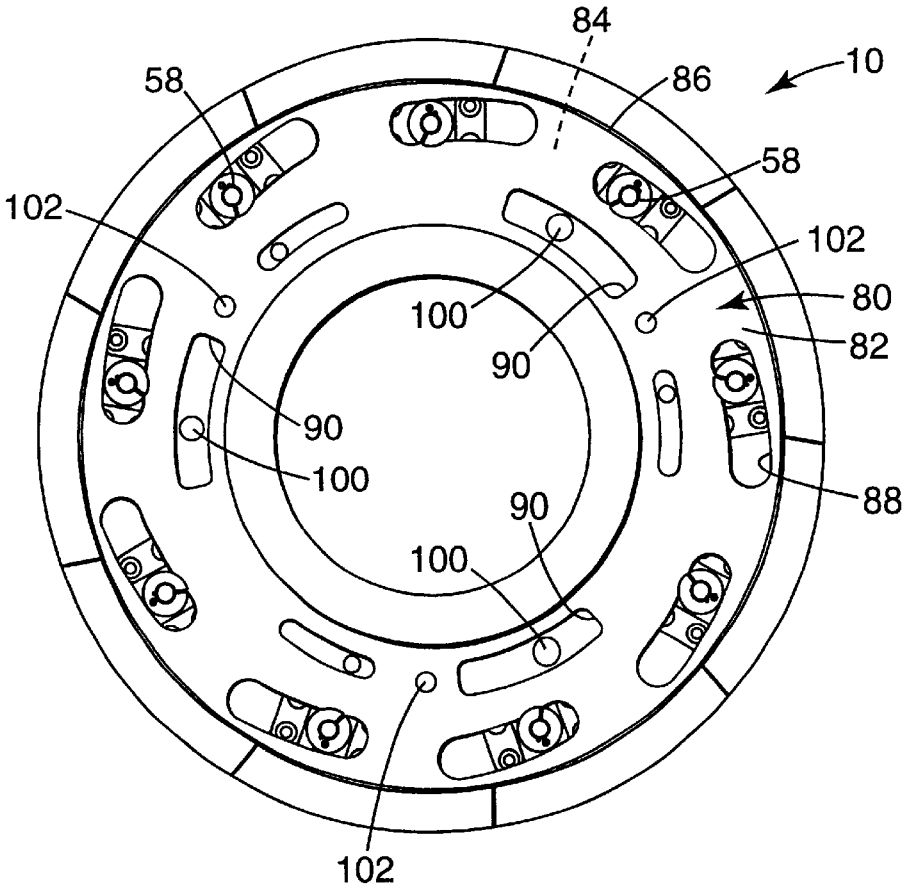
FIG. 5 is the expandable wheel of FIG. 1 including the cam, showing the wheel in its first radial position.

FIG. 5 illustrates the expandable wheel 10 including the cam 80. The cam 80 is used to move the wheel segments 30 from the first radial position to the second radial position simultaneously. The cam 80 includes a first major surface 82 and a second major surface 84 opposite the first major surface 82 and includes a peripheral surface 86 between the first major surface 82 and the second major surface 84. The cam 80 is engaged with the hub 12 and rotates circumferentially about the hub 12. The cam 80 includes cam slots 88 located around the outside perimeter of the cam 80. Each of slots 88 includes a first radial end and a second radial end opposite the first radial end. The first radial end is radially closer to the center of the hub 12 as compared to the second radial end. The first radial end is located at a first radius from the axis, the second radial end is located at a second radius from the axis, and the first radius is less than the second radius. The cam follower 58 on each wheel Segment 30 is slideably engaged with one of the cam slots 88. Each cam slot 88 is angled to move the cam follower 58 from a first radial position to a second radial position, as explained in more detail below. The cam 80 also includes tensioner bolt slots 90 located around the inside perimeter of the cam 80. The mounting holes 100 in hub 12 are accessible through tensioner bolt slots 90. The cam 80 also includes cam anchors 102 located between adjacent tensioner bolt slots 90.

Figure 6:
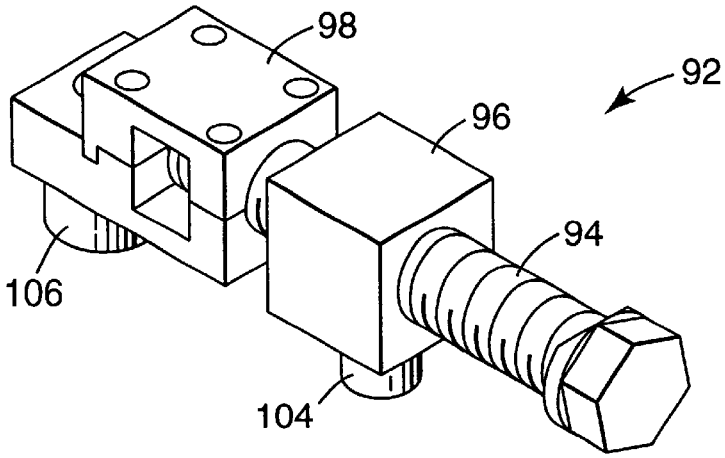
FIG. 6 is an isometric view of a preferred embodiment of a tensioner bolt for use with the expandable wheel of FIG. 1.

FIG. 6 illustrates one preferred embodiment of a tensioner bolt 92. The tensioner bolt 92 includes a threaded bolt 94, a cam link 96, and a union 98. The bolt 94 had threads. The union 98 is mounted on the end of bolt 94. The cam link 96 is moveable along the bolt 94. The cam link 96 includes a cam link peg 104 extending from it. The union 98 has a union peg 106 extending from it. Both the cam link peg 104 and the union peg 106 are extending in the same direction. The cam link peg 104 is sized to fit into the cam anchor 102 in cam 80. The union peg 106 is sized to fit into the mounting hole 100 in hub 12, which is accessible through the tensioner bolt slots 90.

Figure 7A:
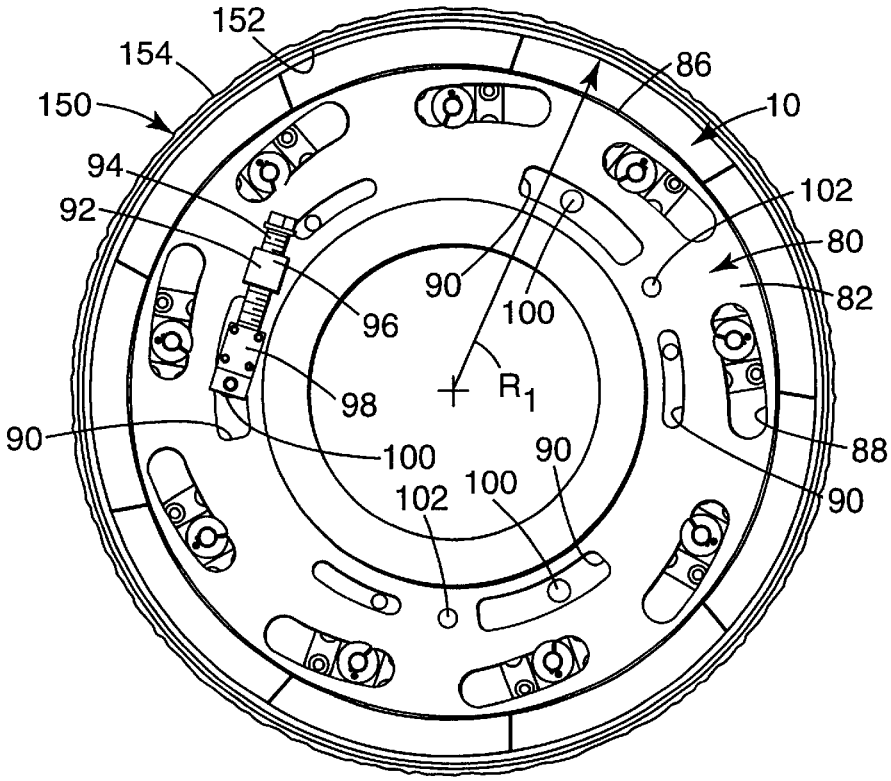
FIG. 7*a* is the expandable wheel of FIG. 1 and the tensioner bolt of FIG. 6, showing the wheel in its first radial position, with an endless abrasive belt centered around the wheel.
Figure 7B:
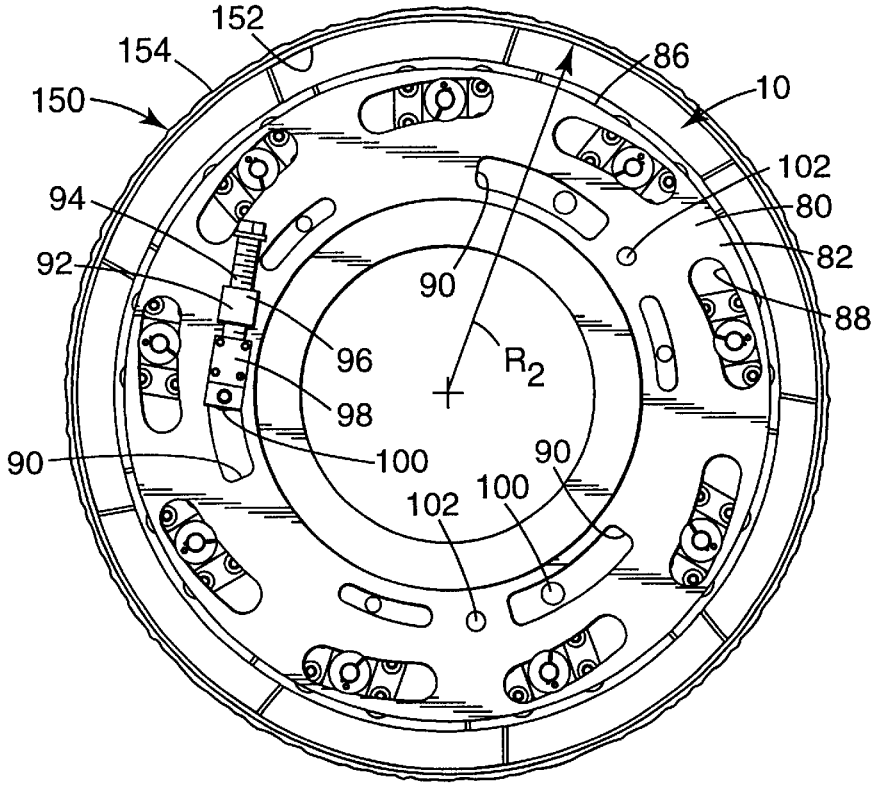
FIG. 7*b* is the expandable wheel and the tensioner bolt of FIG. 7*a*, showing the wheel in its second radial position, supporting the endless abrasive belt.

FIG. 7*a* illustrates the expandable wheel 10 with the wheel segments 30 in the first radial position and an endless abrasive belt 150 centered around the wheel 10. FIG. 7*b* illustrates the expandable wheel 10 with the wheel segments 30 in the second radial position, supporting the endless abrasive belt 150. The abrasive belt 150 includes a backing 152 and an abrasive surface 154 opposite the backing 152. The abrasive belt 150 has a larger radius than the expandable wheel 10 when it is in its first radial position, so it can easily fit around the wheel 10 while the wheel 10 is in the first radial position.

Preferably, the abrasive belt 150 has a radius similar to $R_2$ to match the radius of the expandable wheel 10 when it is in the second radial position. More preferably, the abrasive belt 150 has an inside radius such that when the wheel 10 is expanded, the abrasive belt expands to the middle of its elastic limit. The abrasive belt 150 may be slightly elastic and if so, may include a radius slightly less than $R_2$ to allow a snug fit around the wheel 10 while it is in its expanded state. The abrasive belt 150 may then recover its original size after removal from the wheel.

In both FIGS. 7*a* and 7*b*, the tensioner bolt 92 is engaged with both the cam 80 and the hub 12 of the expandable wheel 10. The cam link peg 104 of the tensioner bolt 92 is attached to the cam anchor 102 in cam 80 and the union peg 106 of the tensioner bolt 92 is attached to the mounting hole 100 in hub 12. To rotate the cam 80 circumferentially about the hub, the bolt 94 is turned to move the cam link 96 closer to the union 98. As the cam link 96 is moved toward the union 98, the cam link 96 pulls the cam 80 with it because the cam link 96 is attached to the cam 80 by the cam link peg 104 and the cam anchor 102. As the cam 80 rotates, the cam followers 58 attached to the wheel segments 30 simultaneously slide along the cam slots 88. As the cam followers 58 slide along the slots, the cam followers 58 move the wheel segments simultaneously from the first radial position to the second radial position. The cam slots 88 are angled to force the cam follower 58 to slide radially in and out as the cam is moved circumferentially back and forth. The mechanical stops 50 stop the wheel segments 30 from advancing any further beyond the second radial position. When the cam 80 is in a first circumferential position, the wheel segments 30 are in the first radial position because the cam follower 58 is at the radially inward end of the cam slot 88. When the cam 80 is a second circumferential position, the wheel segments 30 are in the second radial position because the cam follower 58 is at the radially outward end of the cam slot 88. When the wheel segments are in the second radial position, expandable wheel has a second radius $R_2$, which generally corresponds with the radius of the endless abrasive belt 150. As a result, the individual peripheral surfaces 36 of the wheel segments 30 are space apart and support the backing 152 of the abrasive belt 150.

The cam 80 is designed to move the wheel segments 30 radially without significant axial movement by the cam itself. Preferably, the cam 80 uses no axial movement at all when it rotates circumferentially about the hub 12. The wheel segments move radially, the cam 80 moves circumferentially, but no portion of the wheel 10 moves axially. This advantageously provides an overall thinner wheel 10 as compared to those in the prior art.

The present invention has now been described with reference to several embodiments thereof. The foregoing detailed description and examples have been given for clarity of understanding only. No unnecessary limitations are to be understood therefrom. All patents and patent applications cited herein are hereby incorporated by reference. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. An expandable wheel for supporting an endless abrasive belt, comprising;

a) a hub, including an axis; and b) a wheel segment engaged with said hub, wherein said hub and said wheel segment are adapted to rotate about the axis, wherein said wheel segment is moveable between a first radial position and a second radial position, wherein said first radial position is located at a first radius from the axis, wherein said second radial position is located at a second radius from the axis, wherein said first radius is less than said second radius, wherein said wheel segment includes a peripheral surface for supporting an endless abrasive belt, and wherein said peripheral surface includes a first oblique edge and a second oblique edge opposite said first oblique edge, and wherein said first oblique edge and said second oblique edge are oblique to the direction of wheel rotation.

2. The expandable wheel of claim 1, further comprising a plurality of wheel segments engaged with said hub, wherein said hub and said plurality of wheel segments are adapted to rotate about the axis, wherein said plurality of wheel segments are moveable between said first radial position and said second radial position, and wherein each of said plurality of wheel segments includes said peripheral surface for supporting an endless abrasive belt.

3. The expandable wheel of claim 2, wherein when said wheel segments are in said second radial position, said first oblique edge of a first wheel segment of said plurality of wheel segments is spaced apart from said second oblique edge of a second wheel segment of said plurality of wheel segments.

4. The expandable wheel of claim 2, wherein each of said plurality of wheel segments include a first oblique side surface extending from said first oblique edge, a second oblique side surface extending from said second oblique edge opposite said first oblique side surface, and said peripheral surface extending between said first oblique side surface and said second oblique side surface.

5. The expandable wheel of claim 4, wherein said first oblique side surface of a first wheel segment of said plurality of wheel segments is parallel with said second oblique side surface of a second wheel segment of said plurality of wheel segments.

6. The expandable wheel of claim 4, wherein said first oblique side surface of a first wheel segment of said plurality of wheel segments is parallel with said second oblique side surface of said first wheel segment.

7. The expandable wheel of claim 2, further comprising:

c) means for moving said plurality of wheel segments between said first radial position and said second radial position.

8. The expandable wheel of claim 7, wherein said means for moving said plurality of segments is rotatable between a first circumferential position and a second circumferential position, wherein when said means is in said first circumferential position, said plurality of wheel segments are in said first radial position, and wherein when said means is in said second circumferential position, said plurality of wheel segments are in said second radial position.

9. The expandable wheel of claim 8, wherein said means for moving said plurality of wheel segments comprises:

i) a cam engaged with said hub, wherein said cam includes slots, wherein said each of slots include a first radial end and a second radial end opposite the first radial end, wherein the first radial end is located at a first radius from the axis, wherein the second radial end is located at a second radius from the axis, wherein said first radius is less than said second radius; and ii) cam followers attached to said wheel segments, wherein said cam followers are slideably engaged with said cam slots.

10. The expandable wheel of claim 7, wherein said means for moving said plurality of wheel segments moves all of said plurality of wheel segments simultaneously between said first radial position and said second radial position.

11. The expandable wheel of claim 1, wherein said hub includes a mechanical stop, wherein said mechanical stop prevents said wheel segment from radially expanding beyond said second radial position.

12. An expandable wheel for supporting an endless abrasive belt, comprising:

a) a hub, including an axis;

b) a plurality of wheel segments engaged with said hub, wherein said hub and said plurality of wheel segments are adapted to rotate about the axis, wherein said plurality of wheel segments are moveable from a first radial position to a second radial position, wherein said first position is located at a first radius from the axis, wherein said second position is located at a second radius from the axis, wherein said first radius is less than said second radius, wherein said wheel segment includes a peripheral surface for supporting an endless abrasive belt;

c) a mechanical stop engaged with said hub, wherein said mechanical stop prevents said plurality of wheel segment segments from expanding beyond said second radial position; and d) means for simultaneously moving said plurality of wheel segments between said first radial position and said second radial position.

13. The expandable wheel of claim 12, further comprising a plurality of wheel segments engaged with said hub, wherein said hub and said plurality of wheel segments are adapted to rotate about the axis, wherein said plurality of wheel segments are moveable between said first radial position and said second radial position, and wherein each of said plurality of wheel segments includes said peripheral surface for supporting an endless abrasive belt.

14. The expandable wheel of claim 13, wherein each of said peripheral surfaces includes a first oblique edge and a second oblique edge opposite said first oblique edge, and wherein said first oblique edge and said second oblique edge are oblique to the direction of wheel rotation.

15. The expandable wheel of claim 13, wherein each of said plurality of wheel segments include a first oblique side surface extending from said first oblique edge, a second oblique side surface extending from said second oblique edge opposite said first oblique side surface, and said peripheral surface extending between said first oblique side surface and said second oblique side surface.

16. The expandable wheel of claim 15, wherein said first oblique side surface of a first wheel segment of said plurality of wheel segments is parallel with said second oblique side surface of a second wheel segment of said plurality of wheel segments.

17. The expandable wheel of claim 15, wherein said first oblique side surface of a first wheel segment of said plurality of wheel segments is parallel with said second oblique side surface of said first wheel segment.

18. The expandable wheel of claim 13, wherein when said wheel segments are in said second radial position, said first oblique edge of a first wheel segment of said plurality of wheel segments is spaced apart from said second oblique edge of a second wheel segment of said plurality of wheel segments.

19. The expandable wheel of claim 13, wherein said means for simultaneously moving said plurality of wheel segments is rotatable between a first circumferential position and a second circumferential position, wherein when said means is in said first circumferential position, said plurality of segments are in said first radial position, and wherein when said means is in said second circumferential position, said plurality of segments are in said second radial position.

20. The expandable wheel of claim 19, wherein said means for simultaneously moving said plurality of wheel comprises:

i) a cam engaged with said hub, wherein said cam includes slots, wherein said each of slots include a first radial end and a second radial end opposite the first radial end, wherein the first radial end is located at a first radius from the axis, wherein the second radial end is located at a second radius from the axis, wherein said first radius is less than said second radius; and ii) cam followers attached to said wheel segments, wherein said cam followers are slideably engaged with said cam slots.

21. An expandable wheel for supporting an endless abrasive belt, comprising:

a) a hub, including an axis;

b) a plurality of wheel segments engaged with said hub, wherein said hub and said plurality of wheel segments are adapted to rotate about the axis, wherein said plurality of wheel segments are moveable between a first radial position and a second radial position, wherein said first position is located at a first radius from the axis, wherein said second position is located at a second radius from the axis, wherein said first radius is less than said second radius, and wherein each of said plurality of wheel segments includes a peripheral surface for supporting an endless abrasive belt; and c) means for simultaneously moving said plurality of wheel segments between said first radial position and said second radial position, wherein said means for moving said plurality of wheel segments is rotatable from a first circumferential position to a second circumferential position without significant axial travel, and wherein when said means for simultaneously moving said plurality of wheel segments is in said first circumferential position, said plurality of wheel segments are in said first radial position, and wherein when said means for simultaneously moving said plurality of wheel segments is in said second circumferential position, said plurality of wheel segments are in said second radial position.

22. The expandable wheel of claim 21, wherein each of said peripheral surfaces include a first oblique edge and a second oblique edge opposite said first oblique edge, and wherein said first oblique edge and said second oblique edge are oblique to the direction of wheel rotation.

23. The expandable wheel of claim 22, wherein each of said plurality of wheel segments include a first oblique side surface extending from said first oblique edge, a second oblique side surface extending from said second oblique edge opposite said first oblique side surface, and said peripheral surface extending between said first oblique side surface and said second oblique side surface.

24. The expandable wheel of claim 23, wherein said first oblique side surface of a first wheel segment of said plurality of wheel segments is parallel with said second oblique side surface of a second wheel segment of said plurality of wheel segments.

25. The expandable wheel of claim 23, wherein said first oblique side surface of a first wheel segment of said plurality of wheel segments is parallel with said second oblique side surface of said first wheel segment.

26. The expandable wheel of claim 21, wherein when said plurality wheel segments are in said second radial position, said first oblique edge of a first wheel segment of said plurality of wheel segments is spaced apart from said second oblique edge of a second wheel segment of said plurality of wheel segments.

27. The expandable wheel of claim 21, wherein said hub includes a mechanical stop, wherein said mechanical stop prevents said plurality of wheel segments from radially expanding beyond said second radial position.

28. The expandable wheel of claim 21, wherein said means for simultaneously moving said plurality of wheel segments comprises:

i) a cam engaged with said hub, wherein said cam includes slots, wherein said each of slots include a first radial end and a second radial end opposite the first radial end, wherein the first radial end is located at a first radius from the axis, wherein the second radial end is located at a second radius from the axis, wherein said first radius is less than said second radius; and ii) cam followers attached to said wheel segments, wherein said cam followers are slideably engaged with said cam slots.

29. An expandable wheel for supporting an endless abrasive belt, comprising:

a) a hub, including an axis;

b) a plurality of wheel segments engaged with said hub, wherein said hub and said plurality of wheel segments are adapted to rotate about the axis, wherein said plurality of wheel segments are moveable between a first radial position and a second radial position, wherein said first position is located at a first radius from the axis, wherein said second position is located at a second radius from the axis, wherein said first radius is less than said second radius, and wherein each of said plurality of segments includes a peripheral surface for supporting an endless abrasive belt; and c) means for simultaneously moving said wheel segments between said first radial position and said second radial position.

30. The expandable wheel of claim 29, wherein each of said peripheral surfaces includes a first oblique edge and a second oblique edge opposite said first oblique edge, and wherein said first oblique edge and said second oblique edge are oblique to the direction of wheel rotation.

31. The expandable wheel of claim 29, wherein said plurality of wheel segments include a first oblique side surface extending from said first oblique edge, a second oblique side surface extending from said second oblique edge opposite said first oblique side surface, and said peripheral surface extending between said first oblique side surface and said second oblique side surface.

32. The expandable wheel of claim 31, wherein said first oblique side surface of a first wheel segment of said plurality of wheel segments is parallel with said second oblique side surface of a second wheel segment of said plurality of wheel segments.

33. The expandable wheel of claim 31, wherein said first oblique side surface of a first wheel segment of said plurality of wheel segments is parallel with said second oblique side surface of said first wheel segment.

34. The expandable wheel of claim 30, wherein when said plurality of wheel segments are in said second radial position, said first oblique edge of a first wheel segment of said plurality of wheel segments is spaced apart from said second oblique edge of a second wheel segment of said plurality of wheel segments.

35. The expandable wheel of claim 29, wherein said hub includes a mechanical stop, wherein said mechanical stop prevents said plurality of wheel segments from radially expanding beyond said second radial position.

36. The expandable wheel of claim 29, wherein said means for simultaneously moving said plurality of segments is rotatable between a first circumferential position and a second circumferential position, and wherein when said means is in said first circumferential position, said plurality of segments are in said first radial position, wherein when said means is in said second circumferential position, said plurality wheel of segments are in said second radial position.

37. The expandable wheel of claim 36, wherein said means for simultaneously moving said plurality of wheel comprises:

i) a cam engaged with said hub, wherein said cam includes slots, wherein said each of slots include a first radial end and a second radial end opposite the first radial end, wherein the first radial end is located at a first radius from the axis, wherein the second radial end is located at a second radius from the axis, wherein said first radius is less than said second radius; and ii) cam followers attached to said wheel segments, wherein said cam followers are slideably engaged with said cam slots.

38. An expandable wheel for supporting an endless abrasive belt, comprising:

a) a hub, including an axis;

b) a plurality of wheel segments engaged with said hub, wherein said hub and said plurality of wheel segments are adapted to rotate about the axis, wherein said plurality of wheel segments are moveable from a first radial position to a second radial position, wherein said first position is located at a first radius from the axis, wherein said second position is located at a second radius from the axis, wherein said first radius is less than said second radius, wherein each of said plurality of wheel segments includes a peripheral surface for supporting an endless abrasive belt;

c) a mechanical stop engaged with said hub, wherein said mechanical stop prevents said plurality of wheel segments from expanding beyond said second radial position;

d) a cam engaged with said hub, wherein said cam includes slots, wherein said each of slots include a first radial end and a second radial end opposite the first radial end, wherein the first radial end is located at a first radius from the axis, wherein the second radial end is located at a second radius from the axis, wherein said first radius is less than said second radius; and e) cam followers attached to said wheel segments, wherein said cam followers are slideably engaged with said cam slots.

39. An expandable wheel for supporting an endless abrasive belt, comprising:

a) a hub, including an axis;

b) a plurality of wheel segments engaged with said hub, wherein said hub and said plurality of wheel segments are adapted to rotate about the axis, wherein said plurality of wheel segments are moveable between a first radial position and a second radial position, wherein said first position is located at a first radius from the axis, wherein said second position is located at a second radius from the axis, wherein said first radius is less than said second radius, and wherein each of said plurality of segments includes a peripheral surface for supporting an endless abrasive belt;

c) a cam engaged with said hub, wherein said cam includes slots, wherein said each of slots include a first radial end and a second radial end opposite the first radial end, wherein the first radial end is located at a first radius from the axis, wherein the second radial end is located at a second radius from the axis, wherein said first radius is less than said second radius; and d) cam followers attached to said wheel segments, wherein said cam followers are slideably engaged with said cam slots.

* * * * *

UNITED STATES PATENT AND TRADEMARK OFFICE

CERTIFICATE OF CORRECTION

PATENT NO. : 6,645,060 B2
DATED : November 11, 2003
INVENTOR(S) : Luedeke, Arthur P.

It is certified that error appears in the above-identified patent and that said Letters Patent is hereby corrected as shown below:

Title page,
Item [57], ABSTRACT,
Line 4, delete “an” and insert in place thereof -- a --

Column 4,
Line 56, delete first occurrence of “at”

Column 5,
Line 53, delete first occurrence of “at”

Column 6,
Line 50, delete first occurrence of “at”

Column 7,
Line 7, delete first occurrence of “at”

Column 8,
Lines 41 and 43, delete “angle a” and insert in place thereof -- angle α --

Column 10,
Line 34, delete “mechanical stops X” and insert in place thereof -- mechanical stops 50 --

Column 12,
Line 15, delete “wheel Segment 30” and insert in place thereof -- wheel segment 30 --

UNITED STATES PATENT AND TRADEMARK OFFICE

CERTIFICATE OF CORRECTION

PATENT NO. : 6,645,060 B2
DATED : November 11, 2003
INVENTOR(S) : Luedeke, Arthur P.

It is certified that error appears in the above-identified patent and that said Letters Patent is hereby corrected as shown below:

Column 15,
Lines 7 and 8, delete the word "segment"

Signed and Sealed this

Fifteenth Day of June, 2004

JON W. DUDAS
*Acting Director of the United States Patent and Trademark Office*